US005941259A

United States Patent [19]

Cleveland

[11] Patent Number: 5,941,259

[45] Date of Patent: Aug. 24, 1999

[54] SHOE WASHING AND DRYING DEVICE

[76] Inventor: Gregory A. Cleveland, 137 Oglethorpe Ave., Milledgeville, Ga. 31061

[21] Appl. No.: 09/082,689

[22] Filed: May 21, 1998

[51] Int. Cl.[6] ..... B08B 3/04

[52] U.S. Cl. ..... 134/95.2; 134/186; 134/201; 134/105

[58] Field of Search ..... 134/95.2, 201, 134/186, 105, 200

[56] References Cited

U.S. PATENT DOCUMENTS

| | | | |
|---|---|---|---|
| 2,273,939 | 2/1942 | Dammers | 202/170 |
| 2,621,666 | 12/1952 | Ornas | 134/57 |
| 2,806,123 | 9/1957 | Steinbock | 219/44 |
| 2,842,144 | 7/1958 | Lyman | 134/57 |
| 3,181,541 | 5/1965 | Brooking | 134/186 |
| 4,080,975 | 3/1978 | Williams | 134/94 |
| 5,433,230 | 7/1995 | Miller | 134/110 |
| 5,601,100 | 2/1997 | Kawakami | 134/56 R |
| 5,711,327 | 1/1998 | Fields | 134/105 |

*Primary Examiner*—Frankie L. Stinson
*Assistant Examiner*—Mialeeka C. Williams-Bibbs

[57] ABSTRACT

A new shoe washing and drying device for washing and drying shoes. The inventive device includes a housing dimensioned for receiving a pair of shoes therein. The housing holds a predetermined quantity of water therein. A shoe support rack is secured within the housing for supporting the pair of shoes thereof. A pump mechanism is disposed interiorly of the housing on a closed lower end thereof. The pump mechanism is disposed below the water within the housing. The pump mechanism has openings in a lower end for receiving the water therein. A water conduit extends outwardly from the pump mechanism along an interior surface of the closed lower end of the housing. The water conduit has an upper portion extending upwardly along an interior surface of a front wall of the housing. A manifold is secured to and is in communication with an upper end of the upper portion of the water conduit. The manifold has a plurality of nozzles extending outwardly therefrom directed inwardly with respect to the housing. A heating device is secured to an exterior surface of the back wall of the housing. The heating device includes a blower and heating elements therein. The heating device is in communication with a manifold disposed on an interior surface of a back wall of the housing. The manifold has a plurality of nozzles extending outwardly therefrom for directing heated air within the housing.

11 Claims, 2 Drawing Sheets

SHOE WASHING AND DRYING DEVICE

BACKGROUND OF THE INVENTION

1. Field of the Invention

The present invention relates to shoe washing and drying device and more particularly pertains to a new shoe washing and drying device for washing and drying shoes.

2. Description of the Prior Art

The use of washing machines is known in the prior art. More specifically, washing machines heretofore devised and utilized are known to consist basically of familiar, expected and obvious structural configurations, notwithstanding the myriad of designs encompassed by the crowded prior art which have been developed for the fulfillment of countless objectives and requirements.

Known prior art washing machines include U.S. Pat. No. 5,418,996 to Chen; U.S. Pat. No. 4,435,964 to Misawa; U.S. Pat. No. 3,737,942 to Casey; U.S. Pat. No. 4,724,564 to Fresh; U.S. Pat. No. 3,077,624 to Gerard; and U.S. Pat. No. 5,617,646 to Viscuso.

While these devices fulfill their respective, particular objectives and requirements, the aforementioned patents do not disclose a new shoe washing and drying device. The inventive device includes a housing dimensioned for receiving a pair of shoes therein. The housing holds a predetermined quantity of water therein. A shoe support rack is secured within the housing for supporting the pair of shoes thereof. A pump mechanism is disposed interiorly of the housing on a closed lower end thereof. The pump mechanism is disposed below the water within the housing. The pump mechanism has openings in a lower end for receiving the water therein. A water conduit extends outwardly from the pump mechanism along an interior surface of the closed lower end of the housing. The water conduit has an upper portion extending upwardly along an interior surface of a front wall of the housing. A manifold is secured to and is in communication with an upper end of the upper portion of the water conduit. The manifold has a plurality of nozzles extending outwardly therefrom directed inwardly with respect to the housing. A heating device is secured to an exterior surface of the back wall of the housing. The heating device includes a blower and heating elements therein. The heating device is in communication with a manifold disposed on an interior surface of a back wall of the housing. The manifold has a plurality of nozzles extending outwardly therefrom for directing heated air within the housing.

In these respects, the shoe washing and drying device according to the present invention substantially departs from the conventional concepts and designs of the prior art, and in so doing provides an apparatus primarily developed for the purpose of washing and drying shoes.

SUMMARY OF THE INVENTION

In view of the foregoing disadvantages inherent in the known types of washing machines now present in the prior art, the present invention provides a new shoe washing and drying device construction wherein the same can be utilized for washing and drying shoes.

The general purpose of the present invention, which will be described subsequently in greater detail, is to provide a new shoe washing and drying device apparatus and method which has many of the advantages of the washing machines mentioned heretofore and many novel features that result in a new shoe washing and drying device which is not anticipated, rendered obvious, suggested, or even implied by any of the prior art washing machines, either alone or in any combination thereof.

To attain this, the present invention generally comprises a housing having a generally rectangular housing. The housing is dimensioned for receiving a pair of shoes therein. The housing is defined by an open upper end, a closed lower end, a front wall, a back wall and opposing side walls. The open upper end has a lid hingedly coupled therewith. The lid has a handle disposed on an upper surface thereof. The closed lower end has support feet disposed in corners thereof. The front wall has a drainage hole therethrough. The drainage hole has a drain plug removably disposed therein. The housing holds a predetermined quantity of water therein. A shoe support rack is secured within the housing. The shoe support rack extends between the opposing side walls of the housing. The shoe support rack is disposed above the water within the housing. A soap container is secured to an interior surface of the back wall of the housing. The soap container holds a quantity of liquid soap therein. A pump mechanism is disposed interiorly of the housing on the closed lower end thereof. The pump mechanism is disposed below the water within the housing. The pump mechanism has a plug extending outwardly of the housing for mating with an electrical outlet. The pump mechanism has openings in a lower end for receiving the water therein. A water conduit extends outwardly from the pump mechanism along an interior surface of the closed lower end of the housing. The water conduit has an upper portion extending upwardly along an interior surface of the front wall of the housing. A manifold is secured to and is in communication with an upper end of the upper portion of the water conduit. The manifold extends along interior surfaces of the front wall and opposing side walls of the housing. The manifold has a plurality of nozzles extending outwardly therefrom directed inwardly with respect to the housing. A heating device is secured to an exterior surface of the back wall of the housing. The heating device includes a blower and heating elements therein. The heating device is in communication with a manifold disposed on the interior surface of the back wall of the housing. The manifold has a plurality of nozzles extending outwardly therefrom for directing heated air within the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shoe washing and drying device apparatus and method which has many of the advantages of the washing machines mentioned heretofore and many novel features that result in a new shoe washing and drying device which is not anticipated, rendered obvious, suggested, or even implied by any of the prior art shoe washing and drying device, either alone or in any combination thereof.

It is another object of the present invention to provide a new shoe washing and drying device which may be easily and efficiently manufactured and marketed.

It is a further object of the present invention to provide a new shoe washing and drying device which is of a durable and reliable construction.

An even further object of the present invention is to provide a new shoe washing and drying device which is susceptible of a low cost of manufacture with regard to both materials and labor, and which accordingly is then susceptible of low prices of sale to the consuming public, thereby making such shoe washing and drying device economically available to the buying public.

Still yet another object of the present invention is to provide a new shoe washing and drying device which provides in the apparatuses and methods of the prior art some of the advantages thereof, while simultaneously overcoming some of the disadvantages normally associated therewith.

Still another object of the present invention is to provide a new shoe washing and drying device for washing and drying shoes.

Yet another object of the present invention is to provide a new shoe washing and drying device which includes a housing dimensioned for receiving a pair of shoes therein. The housing holds a predetermined quantity of water therein. A shoe support rack is secured within the housing for supporting the pair of shoes thereof. A pump mechanism is disposed interiorly of the housing on a closed lower end thereof. The pump mechanism is disposed below the water within the housing. The pump mechanism has openings in a lower end for receiving the water therein. A water conduit extends outwardly from the pump mechanism along an interior surface of the closed lower end of the housing. The water conduit has an upper portion extending upwardly along an interior surface of a front wall of the housing. A manifold is secured to and is in communication with an upper end of the upper portion of the water conduit. The manifold has a plurality of nozzles extending outwardly therefrom directed inwardly with respect to the housing. A heating device is secured to an exterior surface of the back wall of the housing. The heating device includes a blower and heating elements therein. The heating device is in communication with a manifold disposed on an interior surface of a back wall of the housing. The manifold has a plurality of nozzles extending outwardly therefrom for directing heated air within the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
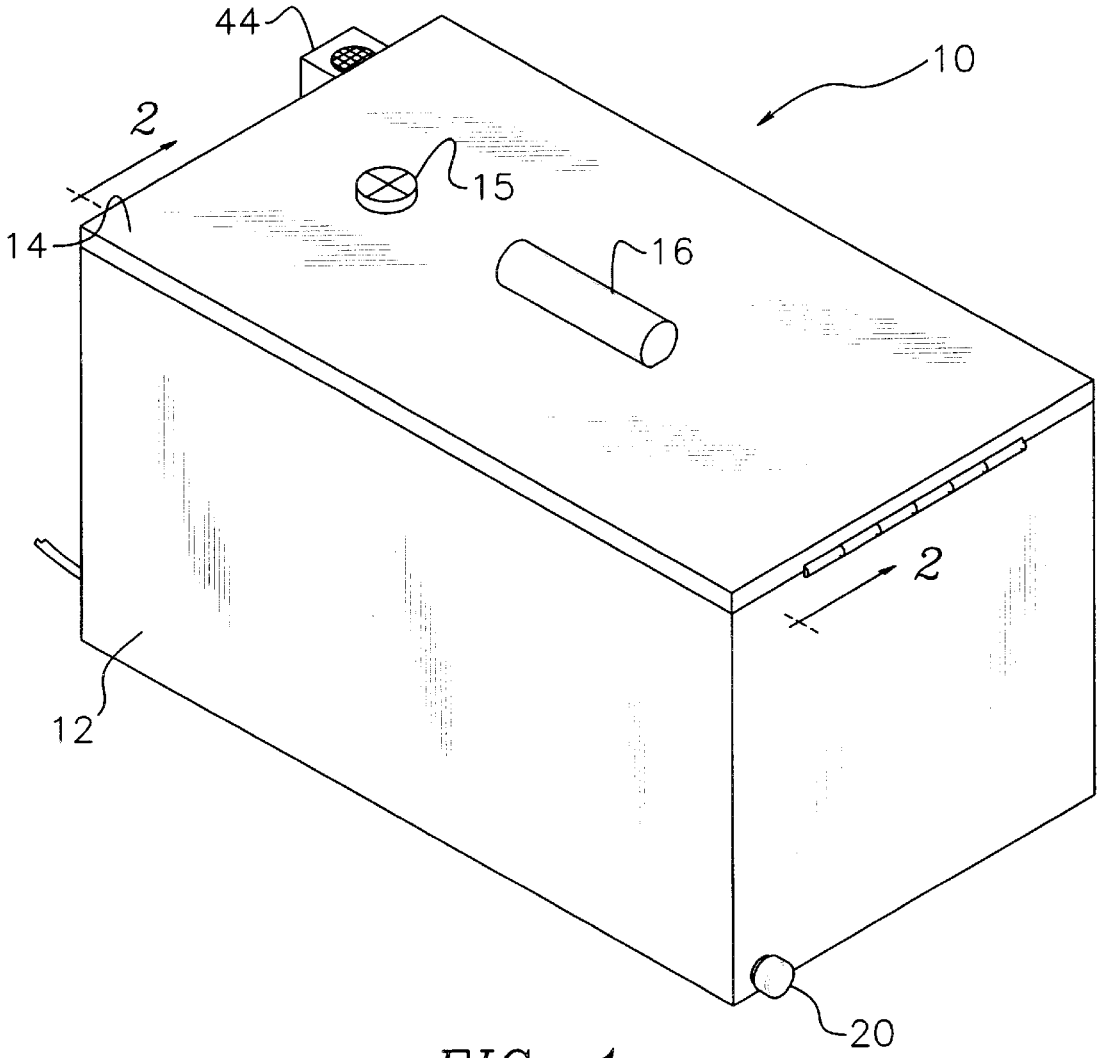
FIG. 1 is a perspective view of a new shoe washing and drying device according to the present invention.
Figure 2:
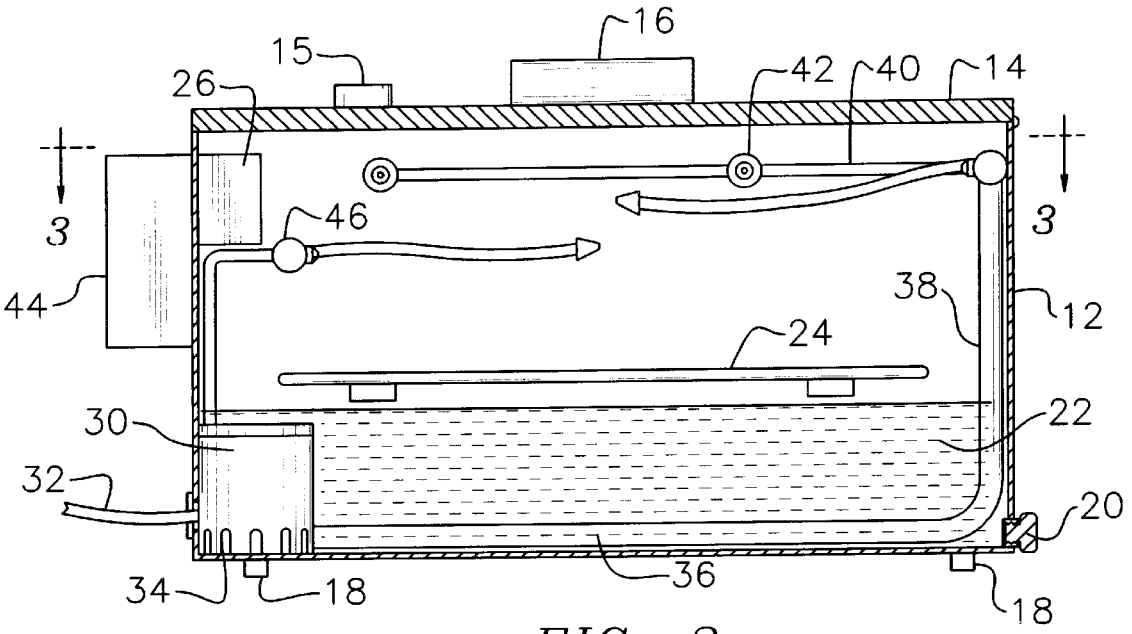
FIG. 2 is a cross-sectional view of the present invention as taken along line 2—2 of FIG. 1.
Figure 3:
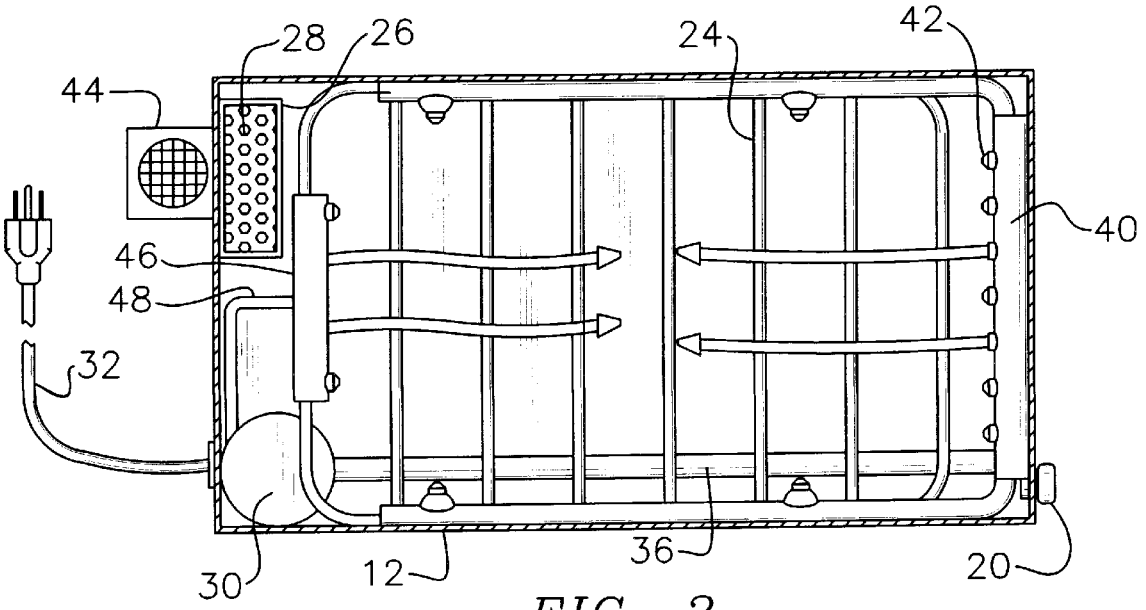
FIG. 3 is a cross-sectional view of the present invention as taken along line 3—3 of FIG. 2.

With reference now to the drawings, and in particular to FIGS. 1 through 3 thereof, a new shoe washing and drying device embodying the principles and concepts of the present invention and generally designated by the reference numeral 10 will be described.

As best illustrated in FIGS. 1 through 3, the shoe washing and drying device 10 comprises a housing 12 having a generally rectangular housing. The housing 12 is dimensioned for receiving a pair of shoes therein. The housing 12 is defined by an open upper end, a closed lower end, a front wall, a back wall and opposing side walls. The open upper end has a lid 14 hingedly coupled therewith. The lid 14 has a handle 16 disposed on an upper surface thereof. The lid 14 could also be provided with a vented opening 15. The closed lower end has support feet 18 disposed in corners thereof. The front wall has a drainage hole therethrough. The drainage hole has a drain plug 20 removably disposed therein. The housing 12 holds a predetermined quantity of water 22 therein.

A shoe support rack 24 is secured within the housing 12. The shoe support rack 24 supports the pair of shoes thereon. The shoe support rack 24 extends between the opposing side walls of the housing 12. The shoe support rack 24 is disposed above the water 22 within the housing 12.

A soap container 26 is secured to an interior surface of the back wall of the housing 12. The soap container 26 holds a quantity of liquid soap 28 therein. The soap container 26 can preferably be removed to pour the liquid soap 28 into the water 22 prior to use.

A pump mechanism 30 is disposed interiorly of the housing 12 on the closed lower end thereof. The pump mechanism 30 is disposed below the water 22 within the housing 12. The pump mechanism 30 has a plug 32 extending outwardly of the housing for mating with an electrical outlet. The pump mechanism 30 has openings 34 in a lower end for receiving the water 22 therein.

A water conduit 36 extends outwardly from the pump mechanism 30 along an interior surface of the closed lower end of the housing 12. The water conduit 36 has an upper portion 38 extending upwardly along an interior surface of the front wall of the housing 12.

A manifold 40 is secured to and is in communication with an upper end of the upper portion 38 of the water conduit 36. The manifold 40 extends along interior surfaces of the front wall and opposing side walls of the housing 12. The manifold 40 has a plurality of nozzles 42 extending outwardly therefrom directed inwardly with respect to the housing 12.

A heating device 44 is secured to an exterior surface of the back wall of the housing 12. The heating device 44 includes a blower and heating elements therein. The heating device 44 is in communication with a manifold 46 disposed on the interior surface of the back wall of the housing 12. The manifold 46 has a plurality of nozzles 48 extending outwardly therefrom for directing heated air within the housing 12.

In use, the device 10 is placed within a tub or sink and would fill the housing 12 and the soap container 26. The feet 18 would prevent the device 10 from scratching the surfaces. The lid 14 would be opened via the handle 16, and the user would place the pair of shoes onto the support rack 24. The lid 14 would be closed and the pump mechanism 30 would be activated to spray soapy water over the shoes through the spray nozzles 42. After the shoes have been rinsed, the heating device 44 would be activated to dry the shoes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new shoe washing and drying device for washing and drying shoes comprising, in combination:

a housing having a generally rectangular housing, the housing being dimensioned for receiving a pair of shoes therein, the housing being defined by an open upper end, a closed lower end, a front wall, a back wall and opposing side walls, the open upper end having a lid hingedly coupled therewith, the lid having a handle disposed on an upper surface thereof, the closed lower end having support feet disposed in corners thereof, the front wall having a drainage hole therethrough, the drainage hole having a drain plug removably disposed therein, the housing holding a predetermined quantity of water therein;

a shoe support rack secured within the housing, the shoe support rack extending between the opposing side walls of the housing, the shoe support rack being disposed above the water within the housing;

a soap container secured to an interior surface of the back wall of the housing, the soap container holding a quantity of liquid soap therein;

a pump mechanism disposed interiorly of the housing on the closed lower end thereof, the pump mechanism being disposed below the water within the housing, the pump mechanism having a plug extending outwardly of the housing for mating with an electrical outlet, the pump mechanism having openings in a lower end for receiving the water therein;

a water conduit extending outwardly from the pump mechanism along an interior surface of the closed lower end of the housing, the water conduit having an upper portion extending upwardly along an interior surface of the front wall of the housing;

a manifold secured to and in communication with an upper end of the upper portion of the water conduit, the manifold extending along interior surfaces of the front wall and opposing side walls of the housing, the manifold having a plurality of nozzles extending outwardly therefrom directed inwardly with respect to the housing;

a heating device secured to an exterior surface of the back wall of the housing, the heating device including a blower and heating elements therein, the heating device being in communication with a manifold disposed on the interior surface of the back wall of the housing, the manifold having a plurality of nozzles extending outwardly therefrom for directing heated air within the housing.

2. A new shoe washing and drying device for washing and drying shoes comprising, in combination:

a housing dimensioned for receiving a pair of shoes therein, the housing holding a predetermined quantity of water therein;

a shoe support rack secured within the housing;

a pump mechanism disposed interiorly of the housing on a closed lower end thereof, the pump mechanism being disposed below the water within the housing, the pump mechanism having openings in a lower end for receiving the water therein;

a water conduit extending outwardly from the pump mechanism along an interior surface of the closed lower end of the housing, the water conduit having an upper portion extending upwardly along an interior surface of a front wall of the housing;

a manifold secured to and in communication with an upper end of the upper portion of the water conduit, the manifold having a plurality of nozzles extending outwardly therefrom directed inwardly with respect to the housing;

a heating device secured to an exterior surface of the back wall of the housing, the heating device including a blower and heating elements therein, the heating device being in communication with a manifold disposed on an interior surface of a back wall of the housing, the manifold having a plurality of nozzles extending outwardly therefrom for directing heated air within the housing.

3. The shoe washing and drying device as set forth in claim 2 wherein the housing has an open upper end with a lid hingedly coupled therewith.

4. The shoe washing and drying device as set forth in claim 3 wherein the lid has a handle disposed on an upper surface thereof.

5. The shoe washing and drying device as set forth in claim 2 wherein the closed lower end of the housing have support feet disposed in corners thereof.

6. The shoe washing and drying device as set forth in claim 2 wherein the front wall of the housing has a drainage hole therethrough, the drainage hole has a drain plug removably disposed therein.

7. The shoe washing and drying device as set forth in claim 2 wherein the shoe support rack extends between opposing side walls of the housing, the shoe support rack being disposed above the water within the housing.

8. The shoe washing and drying device as set forth in claim 2 and further including a soap container secured to an interior surface of the back wall of the housing, the soap container holding a quantity of liquid soap therein.

9. The shoe washing and drying device as set forth in claim 2 wherein the pump mechanism has a plug extending outwardly of the housing for mating with an electrical outlet.

10. The shoe washing and drying device as set forth in claim 2 wherein the manifold of connected to the water conduit extends along interior surfaces of a front wall and opposing side walls of the housing.

11. The shoe washing and drying device as set forth in claim 2 wherein the heating device includes a blower and heating elements threin.

* * * * *